US007342566B2

(12) United States Patent
Ha et al.

(10) Patent No.: US 7,342,566 B2
(45) Date of Patent: Mar. 11, 2008

(54) LIQUID CRYSTAL DISPLAY DEVICE AND DRIVING METHOD THEREOF

(75) Inventors: Yong Min Ha, Kumi-shi (KR); Soon Kwang Hong, Daegu (KR); Han Wook Hwang, Seoul (KR)

(73) Assignee: LG.Philips LCD Co., Ltd., Seoul (KR)

( * ) Notice: Subject to any disclaimer, the term of this patent is extended or adjusted under 35 U.S.C. 154(b) by 683 days.

(21) Appl. No.: 10/721,296

(22) Filed: Nov. 26, 2003

(65) Prior Publication Data

US 2004/0207593 A1 Oct. 21, 2004

(30) Foreign Application Priority Data

Mar. 4, 2003 (KR) ..... 10-2003-0013360

(51) Int. Cl.
*G09G 3/36* (2006.01)

(52) U.S. Cl. ..... 345/100; 345/94; 345/99

(58) Field of Classification Search ..... 345/96, 345/98–100, 103, 87, 92, 94
See application file for complete search history.

(56) References Cited

U.S. PATENT DOCUMENTS

| | | | | |
|---|---|---|---|---|
| 5,784,042 | A * | 7/1998 | Ono et al. | 345/94 |
| 6,335,721 | B1 * | 1/2002 | Jeong | 345/100 |
| 6,628,261 | B1 * | 9/2003 | Sato et al. | 345/99 |
| 6,914,587 | B2 * | 7/2005 | Kosaka | 345/89 |

* cited by examiner

*Primary Examiner*—Jimmy H. Nguyen
(74) *Attorney, Agent, or Firm*—McKenna Long & Aldridge LLP

(57) ABSTRACT

A liquid crystal display (LCD) device includes a control chip arranged on a print circuit board (PCB); a sampling switch array arranged on an LCD panel for applying video signals from the control chip to data lines of the LCD panel; and a switch controller for controlling the sampling switch array in accordance with control signals and the video signal applied from the control chip.

32 Claims, 15 Drawing Sheets

FIG.6A
RELATED ART

| | | | | | | | |
|---|---|---|---|---|---|---|---|
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |

FIG.6B
RELATED ART

| | | | | | | | |
|---|---|---|---|---|---|---|---|
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |

FIG. 7A
RELATED ART

| | | | | | | | |
|---|---|---|---|---|---|---|---|
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |

FIG. 7B
RELATED ART

| | | | | | | | |
|---|---|---|---|---|---|---|---|
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |

FIG.8A
RELATED ART

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

FIG.8B
RELATED ART

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

LIQUID CRYSTAL DISPLAY DEVICE AND DRIVING METHOD THEREOF

This application claims the benefit of the Korean Patent Application No. 2003-13360 filed on Mar. 4, 2003, which is hereby incorporated by reference for all purposes as if fully set forth herein.

BACKGROUND OF THE INVENTION

1. Field of the Invention

The present invention relates to liquid crystal display (LCD) devices and driving methods thereof. More particularly, the present invention relates to an LCD device capable of displaying video signals to a substantially uniform brightness while reducing power consumption and to a driving method thereof.

2. Description of the Related Art

Generally, liquid crystal display (LCD) devices display pictures by controlling light transmittance characteristics of liquid crystal material in accordance with applied electric fields. Accordingly, LCD devices typically include an LCD panel having a plurality of liquid crystal cells arranged in a matrix pattern, and a drive circuit for driving the LCD panel.

The LCD panel generally includes a plurality of gate lines; a plurality of data lines crossing the plurality of gate lines, wherein the liquid crystal cells are arranged at crossings of the gate and data lines; pixel electrodes connected to respective ones of the data lines; and a common electrode, wherein pixel electrodes and the common electrode generate electric fields that control the light transmittance characteristics of the liquid crystal material. Each liquid crystal cell includes a switching device such as a thin film transistor (TFT) having source and drain terminals that connect respective ones of the pixel electrode to corresponding data lines. Further, each TFT includes a gate terminal that is connected to a corresponding gate line.

The drive circuit generally includes a gate driver for driving the gate lines and a data driver for driving the data lines. The gate driver sequentially applies scan signals to the plurality of gate lines to sequentially drive rows of liquid crystal cells. Whenever a scan signal is applied to a gate line, the data driver simultaneously applies video signals to each of the data lines. Accordingly, the video signals applied by the data driver selectively generate electric fields between each pixel electrode and the common electrode. By generating the electric fields, light transmittance characteristics of liquid crystal material within the liquid crystal cells are selectively controlled to display images.

The TFTs within the related art LCD panel are either amorphous silicon-type or polycrystalline silicon-type TFTs, based on whether the semiconductor layer of the TFT is formed of amorphous silicon or polycrystalline silicon.

The semiconductor layer from which the amorphous silicon-type TFTs is amorphous in structure and is therefore thermodynamically stable. However, amorphous silicon-type TFTs have a relatively low charge mobility compared to polycrystalline silicon-type TFTs. As a result, amorphous silicon-type TFTs are difficult to incorporate into LCD panels having a high pixel density. Further, when amorphous silicon-type TFTs are used within the LCD panel, the aforementioned drive circuits (e.g., the gate driver and the data driver) must be separately fabricated and mounted onto the liquid crystal display panel. When drive circuits must be separately fabricated and subsequently mounted, the cost of fabricating the LCD device increases undesirably.

When, however, TFTs of the LCD panel are provided as polycrystalline silicon-type TFTs, the drive circuits can be beneficially formed directly on (i.e., integrated onto) the LCD panel. Accordingly, the fabricating cost of LCD devices having polycrystalline silicon-type TFTs is less than the fabricating cost of LCD devices having amorphous silicon-type TFTS. Moreover, polycrystalline silicon-type TFTs have a relatively high charge mobility compared to amorphous silicon-type TFTs, and are therefore easily incorporated into LCD panels having high pixel density devices. Due to their relatively high charge mobility, polycrystalline silicon-type TFTs have a faster response time than amorphous silicon-type TFTs. Based on the above, use of polycrystalline silicon-type TFTs is preferable to use of amorphous silicon-type TFTs.

FIG. 1 schematically illustrates a related art liquid crystal display (LCD) device incorporating polycrystalline silicon-type thin film transistors (TFTs).

Referring to FIG. 1, the related art LCD device incorporating polycrystalline silicon-type TFTs generally includes a LCD panel 10 having a picture display area 12, a gate shift register 16, and a sampling switch array 14; a printed circuit board (PCB) 20; a control chip 22 and a switch controller 24 mounted on the PCB 20, wherein a control circuit and a data driver integrated circuit (IC) (not shown) are integrated within the control chip 22 and wherein the switch controller 24 controls the sampling switch array 14; and a flexible printed circuit (FPC) film 18 electrically connecting the LCD panel 10 with the PCB 20. Although the switch controller 24 as illustrated in FIG. 1 is mounted on the PCB 20, the switch controller 24 can also be mounted directly on the liquid crystal display panel 10.

The picture display area 12 displays pictures via a plurality of liquid crystal cells LC arranged in a matrix pattern. Each liquid crystal cell LC includes a switching device such as a polycrystalline silicon-type TFT, wherein each TFT is arranged at crossings of gate lines GL and data lines DL. The data lines DL receive video signals applied from the sampling switch array 14 while the gate lines GL receive gate pulses applied from the gate shift register 16.

The gate shift register 16 shifts control signals (start pulses) applied by the control chip 22 to sequentially apply gate pulses to the gate lines GL.

Integrated with the control chip 22, the control circuit applies control signals necessary for driving the switch controller 24 and the gate shift register 16. Further, the control circuit applies externally supplied digital data signals to the data driver IC. The data driver IC converts digital data signals applied from the control circuit into analog video signals and applies the analog video signals to a plurality of data supply lines PD. The data driver IC sequentially applies m number of video signals (where m is an integer equal to or greater than 1) to the data supply lines PD. The m number of video signals applied to the data supply lines PD are then applied to the sampling switch array 14 via the FPC film 18.

The sampling switch array 14 then divides the m number of video signals applied from the data supply lines PD and applies the divided video signals to the data lines DL. To this end, and while referring to FIG. 2, the related art sampling switch array 14 typically includes a plurality of switching blocks 29 and 30, wherein each of the switching blocks 29 and 30 include m number of switching devices S1 to Sm provided as PMOS transistors.

As shown in FIG. 2, each of the switching devices S1 to Sm within a switching block is commonly connected to a single data supply line PD and to a unique data line DL.

Further, each of the switching devices S1 to Sm within a switching block is connected to one of m number of control lines C1 to Cm. Accordingly, the switching devices S1 to Sm transmit the m number of video signals from a data supply line PD to m number of data lines DL.

Referring to FIG. 3, the switch controller 24 sequentially applies turn-on pulses TP to the m number of control lines C1 to Cm, wherein a turn-on pulse TP includes a voltage drop from a high voltage Vh to a low voltage Vl. Referring to FIG. 4, the switch controller 24 shown in FIG. 1 typically includes m number of level shifters 32*l* to 32*m*, wherein each level shifter receives a high voltage Vhi (10V), and a low voltage Vli (−8V), from a power source (not shown). In receipt of the high and low voltages Vhi and Vli, each level shifter applies a turn-on pulse TP to a corresponding control line C1 to Cm in accordance with control signals supplied by the control chip 22.

Referring to FIGS. 2 and 3, a process of applying video signals to the data lines DL will now be explained in greater detail.

Initially, the switch controller 24 applies a first turn-on pulse TP1 to the first control line C1. Applied to the first control line C1, the first turn-on pulse TP1 is applied to the gate terminals of the first switching devices S1, thereby turning the first switching devices S1 on. When the first switching devices S1 are turned on, video signals applied to data supply lines PD are applied to the data lines DL1, DLm+1, etc. Next, a second turn-on pulse TP2 is applied to the second control line C2 which, in turn, is applied to the gate terminals of the second switching devices S2, thereby turning the second switching devices S2 on. When the second switching devices S2 are turned on, the video signals applied to the data supply lines PD are applied to the data lines DL2, DLm+2, etc. The aforementioned process of applying turn-on pulses TP and video signals is repeated for each of the switching devices S1 to Sm such that video signals are sequentially applied to the data lines DL and a predetermined image is displayed by the picture display area 12.

Generally, liquid crystal cells LC within the picture display area 12 are driven according to an inversion driving method such as a frame inversion method, field inversion method, line (or column) inversion method, or dot inversion method.

According to the frame inversion method shown in FIGS. 5A and 5B, the polarity of video signals applied to the liquid crystal cells LC is inverted whenever a frame of the picture display area 12 changes from an odd numbered frames (as shown in FIG. 5A) to an even numbered frame (as shown in FIG. 5B). Similarly, according to the field inversion method, the polarity of video signals applied to one field of liquid crystal cells LC is opposite the polarity of video signals applied to another field of liquid crystal cells LC in a frame of the picture display area 12. Moreover, the polarity of the video signals applied to the fields of liquid crystal cells LC is inverted whenever a frame of the picture display area 12 changes. Driving liquid crystal cells LC according to either the frame or field inversion methods advantageously consumes a minimal amount of power compared to other inversion methods such as line (or column) and dot inversion methods. However, either an entirety of, or predetermined fields within, the picture display area 12 undesirably flicker during each frame when the liquid crystal cells LC are driven according to the frame and field inversion methods, respectively.

According to the line inversion method shown in the FIGS. 6A and 6B, the polarity of video signals applied to adjacent horizontal rows of liquid crystal cells LC is inverted. Moreover, the polarity of the video signals applied to the horizontal rows of liquid crystal cells LC is inverted whenever a frame of the picture display area 12 changes from an odd numbered frames (as shown in FIG. 6A) to an even numbered frame (as shown in FIG. 6B). Driving liquid crystal cells LC according to the line inversion method induces a flickering phenomenon that generates a horizontal stripe pattern due to crosstalk between horizontal rows of liquid crystal cells LC.

According to the column inversion method shown in FIGS. 7A and 7B, the polarity of video signals applied to adjacent vertical columns of liquid crystal cells LC is inverted. Moreover, the polarity of the video signals applied to the vertical columns of liquid crystal cells LC is inverted whenever a frame of the picture display area 12 changes from an odd numbered frames (as shown in FIG. 7A) to an even numbered frame (as shown in FIG. 7B). Driving liquid crystal cells LC according to the column inversion method induces a flickering phenomenon that generates a vertical stripe pattern due to crosstalk between vertical columns of liquid crystal cells LC.

According to the dot inversion method shown in FIGS. 8A and 8B, the polarity of video signals applied to adjacent horizontal rows and vertical columns of liquid crystal cells LC is inverted. Moreover, the polarity of the video signals applied to the horizontal rows and vertical columns of liquid crystal cells LC is inverted whenever a frame of the picture display area 12 changes from an odd numbered frames (as shown in FIG. 8A) to an even numbered frame (as shown in FIG. 8B).

Driving liquid crystal cells LC according to the dot inversion method substantially prevents the flicker phenomenon from being generated because crosstalk between horizontal rows and vertical columns of liquid crystal cells can be substantially offset. However, when driving the LCD device shown in FIG. 1 according to the dot inversion method, a voltage difference is generated between the data lines DL to which the positive and negative polarities video signals. As a result, the picture display area 12 displays images to a non-uniform brightness due to internal resistances within the switching devices S1 to Sm when the polarity of the video signals is inverted.

More specifically, switching devices S1 to Sm, which are turned on to apply the video signals to the data lines DL, have a turn-on resistance, R, wherein $$R\square(L/W)\times[\mu\times Cox\times(Vgs-Vth)]-1$$

and wherein, L represents the channel length of the switching device, W represents the channel width of the switching device, μ represents the charge mobility, Cox represents a capacitance value between the active semiconductor layer and an electrode of the switching device, Vgs represents the voltage applied between the gate terminal and the source terminal of the switching device, and Vth represents the threshold voltage of the switching device.

With the exception of Vgs, values of the variables mentioned above are determined according to the manner in which the switching device was manufactured. Accordingly, the turn-on resistance R of the switching device is made variable when the voltage Vgs, applied between the gate and source terminals of the switching device, changes.

FIG. 9 illustrates voltage differences generated between turn-on signals and video signals applied to PMOS switching devices within the sampling switch array shown in FIG. 1.

Upon driving the liquid crystal display device according to the dot inversion method, the positive and negative voltages are repeatedly applied to the switching devices S1 to Sm based on the common voltage Vcom.

Referring to FIG. 9, when a first turn-on pulse TP1 having the low voltage V1 (−8V) is applied to the gate terminals of the PMOS switching devices S1 via a first control line C1, the PMOS switching devices S1 are turned on and a positive voltage is applied to corresponding data lines DL1, DLm+1, etc., connected to the turned-on PMOS switching devices S1. Accordingly, the Vgs value of the switching devices S1 has a voltage value of V1. When a second turn-on pulse TP2 having the low voltage V1 (−8V) is applied to the gate terminals of the PMOS switching devices S2 via a second control line C2, the PMOS switching devices S2 are turned on and a negative voltage is applied to corresponding data lines DL2, DLm+2, etc., connected to the turned-on PMOS switching devices S2. Accordingly, the Vgs value of the PMOS switching devices S2 has a voltage value of V2, wherein V2 is less than V1.

In view of the above, the turn-on resistance R of PMOS switching devices S change in accordance with the polarity of video signals to be applied to the corresponding data line DL. Accordingly, pictures are displayed within the picture display part 12 to a non-uniform brightness. Moreover, the turn-on resistance R of the PMOS switching devices S is inversely proportional to voltage of the video signal, wherein the PMOS switching device S has a high turn-on resistance R when a negative polarity video signal is applied to the data line DL and a low turn-on resistance when a positive polarity video signal is applied to the data line DL. Accordingly, as the turn-on resistance R increases, the power consumption of each PMOS switching device S increases and the time required to charge liquid crystal cells LC connected to each data line DL increases. As a result, undesirably large amounts of time and energy are required to charge externally applied video signals within the liquid crystal cells LC.

FIG. 10 illustrates voltage differences generated between turn-on signals and video signals applied to NMOS switching devices within the sampling switch array shown in FIG. 1.

As similarly described above, when a first turn-on pulse TP1 having a high voltage Vh (10V) is applied to the gate terminal of the NMOS switching device S1 via the first control line C1, the NMOS switching devices S1 are turned on and a positive voltage is applied to corresponding data lines DL1, DLm+1, etc., connected to the turned-on NMOS switching devices S1. Accordingly, the Vgs value of the switching devices S1 has the voltage value of V2. When a second turn-on pulse TP2 having the high voltage Vh (10V) is applied to the gate terminals of the switching devices S2 via the second control line C2, the NMOS switching devices S2 are turned on and a negative voltage is applied to corresponding data lines DL2, DLm+2, etc., connected to the turned-on NMOS switching devices S2. Accordingly, the Vgs value of the NMOS switching devices S2 has the voltage value of V1, wherein V1 is greater than V2.

SUMMARY OF THE INVENTION

Accordingly, the present invention is directed to a liquid crystal display device and driving method thereof that substantially obviates one or more of the problems due to limitations and disadvantages of the related art.

An advantage of the present invention provides a liquid crystal display device capable of displaying video signals to a substantially uniform brightness while reducing power consumption and to a driving method thereof.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display (LCD) device according to principles of the present invention may, for example, include a control chip arranged on a print circuit board (PCB); a sampling switch array arranged on an LCD panel for applying video signals from the control chip to data lines of the LCD panel; and a switch controller for controlling the sampling switch array according to a control signal and video signals applied from the control chip.

In one aspect of the present invention, the control chip may, for example, include data supply lines for applying video signals to the sampling switch array and to the switch controller, wherein m number (where m is an even integer greater than 1) of video signals are sequentially applied to each of the data supply lines.

In another aspect of the present invention, the sampling switch array may, for example, include switching blocks connected to a unique data supply line, wherein each of the switching blocks includes m number of switching devices for dividing the m number of video signals applied to the data supply lines and for applying the divided video signals to the data lines.

In still another aspect of the present invention, the switch controller may sequentially turn the switching devices on, wherein the m number of video signals are applied to turned-on ones of the switching devices.

In yet another aspect of the present invention, the switch controller turns the switching devices on by alternately applying, to the switching devices, a first turn-on pulse having a first absolute voltage value and a second turn-on pulse having a second absolute voltage value different from the absolute first voltage difference.

In a further aspect of the present invention, the switching devices may be provided as PMOS transistors, the switching controller may apply the first turn-on pulse to the switching devices upon receipt of a positive video signal, and the switching controller may apply the second turn-on pulse to the switching devices upon receipt of a negative video signal.

In still a further aspect of the present invention, the first turn-on pulse includes a voltage drop from a first voltage value to a second voltage value, wherein the first voltage value has a positive polarity and the second voltage value has a negative polarity, and the second turn-on pulse includes a voltage drop from the first voltage value to a third voltage value, wherein the third voltage value has a negative polarity, and wherein an absolute voltage value of the third voltage value is greater than an absolute voltage value of the second voltage value.

In yet a further aspect of the present invention, the switch controller may, for example, include m number of pulse suppliers for applying at least one of the first and second turn-on pulses to each of the m number of switching devices.

In still another aspect of the present invention, each of the pulse suppliers may, for example, include a first level shifter for generating the first turn-on pulse via the first and second voltage values; a second level shifter for generating the second turn-on pulse via the first and third voltage values; a comparator for comparing a voltage value of a common voltage with a voltage value of the video signal; and a selector for applying one of the first and second turn-on pulses to the switching devices based on a selection signal output by the comparator.

In another aspect of the present invention, the comparator may, for example, apply a first selection signal to the selector when a voltage value of the video signal is greater than a voltage value of the common voltage and may apply a second selection signal to the selector when a voltage value of the video signal is not greater than a voltage value of the common voltage.

In one aspect of the present invention, the selector may apply the first turn-on pulse upon receipt of the first selection signal and may apply the second turn-on pulse upon receipt of the second selection signal.

In another aspect of the present invention, the switch controller may be arranged within the liquid crystal display panel.

In still another aspect of the present invention, the switch controller may arranged within the printed circuit board.

In yet another aspect of the present invention, the selector may be arranged within the liquid crystal display panel and the comparator and first and second level shifters are arranged within the printed circuit board.

In a further aspect of the present invention, the pulse supplier may, for example, include a comparator for comparing a voltage value of a common voltage with a voltage value of a video signal; a selector for applying one of the second or third voltages inputted thereto based on a selection signal output by the comparator; and a level shifter for applying one of the first or second turn-on pulses to the switching device via the first voltage inputted thereto and via one of the second or third voltages inputted from the selector.

In still a further aspect of the present invention, the comparator may, for example, apply a first selection signal to the selector when a voltage value of the video signal is greater than a voltage value of the common voltage and may apply a second selection signal to the selector when a voltage value of the video signal is not greater than a voltage value of the common voltage.

In yet a further aspect of the present invention, the selector may apply the second voltage upon receipt of the first selection signal and may apply the third voltage upon receipt of the second selection signal.

In still a further aspect of the present invention, the level shifter may apply the first turn-on pulse upon receipt of the second voltage and may apply the second turn-on pulse upon receipt of the third voltage.

In a further aspect of the present invention, the switching devices may be provided as NMOS transistors, the switching controller may apply the first turn-on pulse to the switching devices upon receipt of a positive video signal, and the switching controller may apply the second turn-on pulse to the switching devices upon receipt of a negative video signal.

In yet another aspect of the present invention, the first turn-on pulse includes a voltage rise from the first voltage value to the second voltage value, wherein the first voltage value has a negative polarity and the second voltage value has a positive polarity, and the second turn-on pulse includes a voltage rise from the first voltage value to a third voltage value, wherein the third voltage value has a positive polarity, and wherein an absolute voltage value of the third voltage is less than an absolute voltage value of the second voltage.

In still another aspect of the present invention, the switch controller may, for example, include m number of pulse suppliers for applying at least one of the first and second turn-on pulses to each of the m number of switching devices.

In another aspect of the present invention, each of the pulse suppliers may, for example, include a first level shifter for generating the first turn-on pulse via the first and second voltages; a second level shifter for generating the second turn-on pulse via the first and third voltages; a comparator for comparing a voltage value of a common voltage with a voltage value of the video signal; and a selector for applying one of the first and second turn-on pulses to any one of the switching devices based on a selection signal output by the comparator.

In one aspect of the present invention, the comparator may, for example, apply a first selection signal to the selector when a voltage value of the video signal is greater than a voltage value of the common voltage and may apply a second selection signal to the selector when a voltage value of the video signal is not greater than a voltage value of the common voltage.

In another aspect of the present invention, the selector may apply the first turn-on pulse upon receipt of the first selection signal and may apply the second turn-on pulse upon receipt of the second selection signal.

In still another aspect of the present invention, the pulse supplier may, for example, include a comparator for comparing a voltage value of a common voltage with a voltage value of a video signal; a selector for applying one of the second or third voltages inputted thereto based on a selection signal output by the comparator; and a level shifter for applying one of the first or second turn-on pulses to the switching device via the first voltage inputted thereto and via one of the second or third voltages inputted from the selector.

In yet another aspect of the present invention, the comparator may, for example, apply a first selection signal to the selector when the voltage value of the video signal is greater than a voltage value of the common voltage and may apply a second selection signal to the selector when a voltage value of the video signal is not greater than a voltage value of the common voltage.

In a further aspect of the present invention, the selector may apply the second voltage upon receipt of the first selection signal and may apply the third voltage upon receipt of the second selection signal.

In still a further aspect of the present invention, the level shifter may apply the first turn-on pulse to the switching device upon receipt of the second voltage and may apply the second turn-on pulse upon receipt of the third voltage.

According to principles of the present invention, a method of driving a liquid crystal display device having a sampling switch array including switching blocks, wherein each switching block includes m number of switches (m is an even integer greater than 1), and a switch controller for applying control signals to each of the m switches, may, for example, include supplying m number of video signals to each of the switching blocks; and alternately applying, to each of the switches, a first turn-on pulse having a first absolute voltage value and a second turn-on pulse having a second absolute voltage value different from the first absolute voltage value to sequentially turn on the m switches, wherein the m number of video signals is applied to data lines via turned-on switches.

In one aspect of the present invention, the switches may be provided as PMOS transistors, the first turn-on pulse may include a voltage drop from a first voltage value to a second voltage value, wherein the first voltage value has a positive polarity and the second voltage value has a negative polarity, and the second turn-on pulse may include a voltage drop from the first voltage value to a third voltage value, wherein the third voltage value has a negative polarity, and wherein an absolute voltage value of the third voltage is greater than an absolute voltage value of the second voltage value.

In another aspect of the present invention, the first turn-on pulse may be applied when a positive video signal is applied to the switches and the second turn-on pulse may be applied when a negative video signal is applied to the switches.

In still another aspect of the present invention, the switches may be provided as NMOS transistors, the first turn-on pulse may include a voltage rise from a first voltage value to a second voltage value, wherein the first voltage value has a negative polarity and the second voltage value has a positive polarity, and the second turn-on pulse may include a voltage rise from the first voltage value to a third voltage value, wherein the third voltage value has a positive polarity, and wherein an absolute voltage value of the third voltage is less than an absolute voltage value of the second voltage value.

In yet another aspect of the present invention, the first turn-on pulse may be applied when a negative video signal is applied to switches and the second turn-on pulse may be applied when a positive video signal is applied to the switches.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 6A and 6B illustrate polarity distribution within liquid crystal cells LC shown in FIG. 1, driven according to a line inversion method;

FIGS. 7A and 7B illustrate polarity distribution within liquid crystal cells LC shown in FIG. 1, driven according to a column inversion method;

FIGS. 8A and 8B illustrate polarity distribution within liquid crystal cells LC shown in FIG. 1, driven according to a dot inversion method;

DETAILED DESCRIPTION OF THE ILLUSTRATED EMBODIMENTS

Reference will now be made in detail to embodiments of the present invention, examples of which are illustrated in the accompanying drawings.

Figure 11:
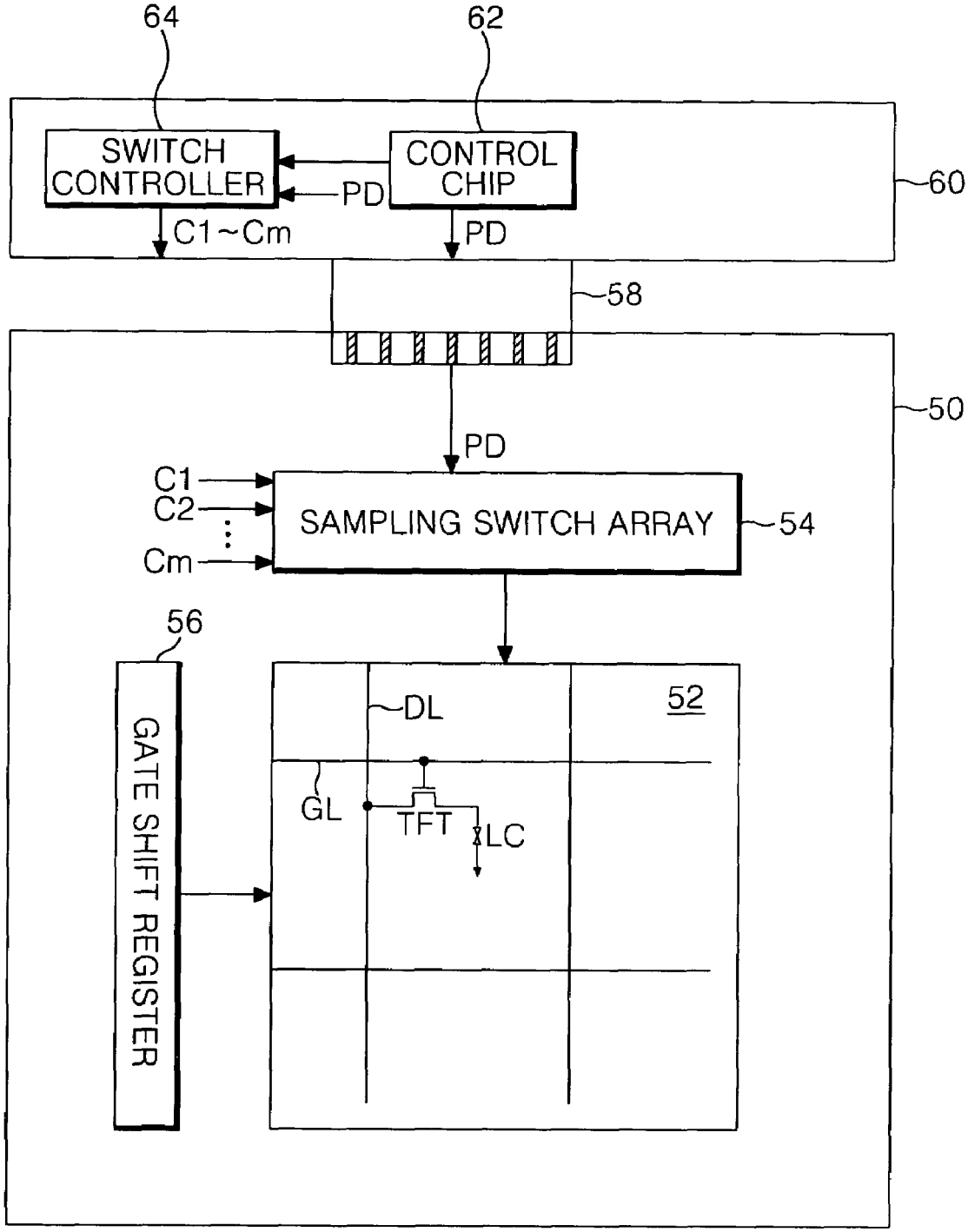
FIG. 11 schematically illustrates a liquid crystal display (LCD) device incorporating polycrystalline silicon-type thin film transistors (TFTs) according to principles of the present invention.

FIG. 11 schematically illustrates a liquid crystal display (LCD) device incorporating polycrystalline silicon-type thin film transistors (TFTs) according to principles of the present invention.

Referring to FIG. 11, the liquid crystal display (LCD) device incorporating polycrystalline silicon-type thin film transistors (TFTs) according to principles of the present invention may, for example, include an LCD panel 50 having a picture display area 52, a gate shift register 56, and a sampling switch array 54; a printed circuit board (PCB) 60; a control chip 62 and a switch controller 64 mounted on the PCB 60, wherein a control circuit and a data driver integrated circuit (IC) may be integrated within the control chip 62 and wherein the switch controller 64 may control the sampling switch array 54; and a flexible printed circuit (FPC) film 58 electrically connecting the LCD panel 50 with the PCB 60. In one aspect of the present invention, the switch controller 64 may be arranged on the LCD panel 50. In another aspect of the present invention, a portion of the switch controller 64 may be arranged on the LCD panel 50.

According to principles of the present invention, the picture display area 52 may display pictures via a plurality of liquid crystal cells LC arranged in a matrix pattern. Each liquid crystal cell LC may, for example, include a polycrystalline silicon-type TFT arranged at a crossing of one of the gate lines GL and one of the data lines DL. In one aspect of the present invention, each TFT may be connected to a corresponding gate line GL and data line DL. In another aspect of the present invention, the data lines DL may receive video signals applied from the sampling switch array 54 while the gate lines GL may receive gate pulses applied from the gate shift register 56.

The gate shift register 56 shifts control signals (start pulses) applied from the control chip 62 to sequentially apply gate pulses to the gate lines GL.

Integrated with the control chip 62, the control circuit may apply the control signals necessary for driving the switch controller 64 and the gate shift register 56. Further, the control circuit applies externally provided digital data signals to the data driver IC. The data driver IC then converts the digital data signals applied from the control circuit into analog video signals and applies the analog video signals to a plurality of data supply lines PD. In one aspect of the present invention, the data driver IC may sequentially apply m number of video signals to the data supply lines PD (where m is an integer equal to or greater than 1). The m number of video signals applied to the data supply lines PD may then be applied to the sampling switch array 54 via the FPC film 58. In one aspect of the present invention, the aforementioned m number of video signals may also be applied to the switch controller 64.

The sampling switch array 54 then divides the m number of video signals applied from the data supply lines PD and applies the divided video signals to the data lines DL. To this end, and while referring to FIG. 18, the sampling switch array 54 may, for example include a plurality of switching blocks, wherein each of the switching blocks may, for example, include m number of switching devices S1 to Sm. In one aspect of the present invention, the switching devices may be provided as PMOS transistors. In another aspect of the present invention, the switching devices may be provided as NMOS transistors.

Figure 18:
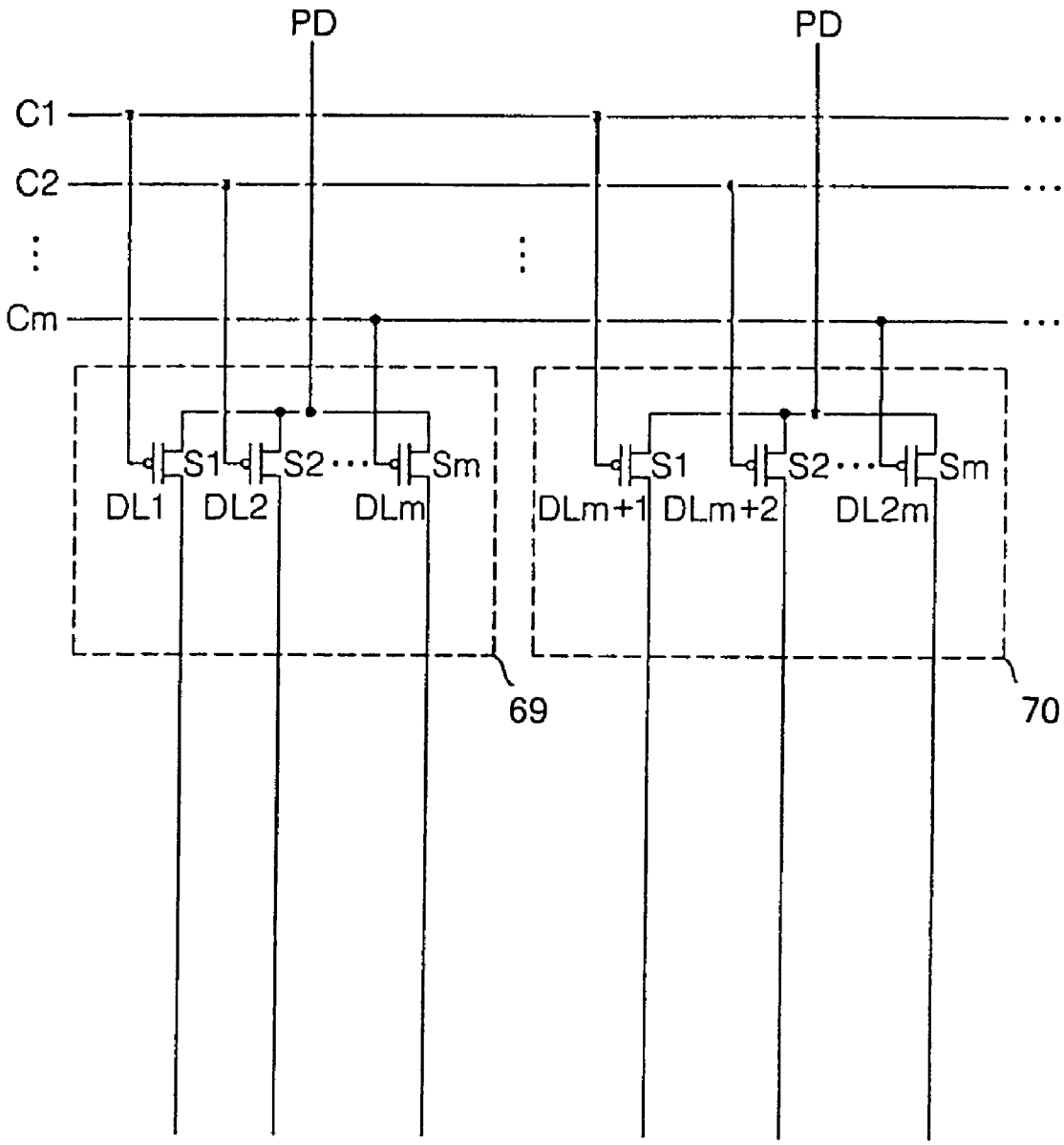
FIG. 18 illustrates the sampling switch array shown in FIG. 11.

As shown in FIG. 18, each of the switching devices S1 to Sm within a switching block may be commonly connected to a single data supply line PD and to a unique data line DL. Further, each of the switching devices S1 to Sm within a switching block may be connected to one of m number of control lines C1q to Cm. Accordingly, the switching devices S1 to Sm transmit the m number of video signals from a particular data supply line PD to corresponding ones of m data lines DL.

According to principles of the present invention, the switch controller 64 may control the voltage value of turn-on pulses TP applied to the m number of control lines C1 to Cm based on a polarity of the video signals applied from the data supply lines PD.

Figure 12A:
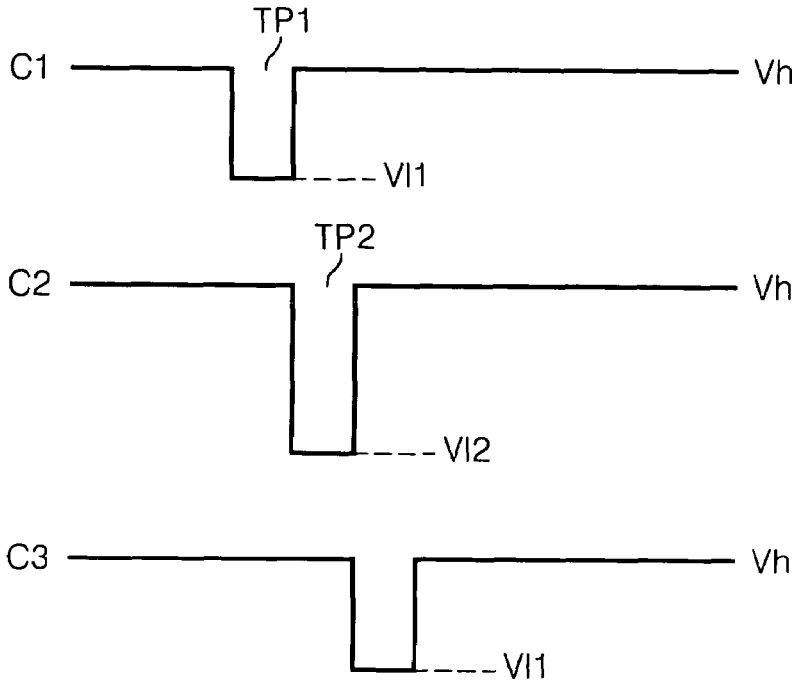
FIGS. 12A and 12B illustrate turn-on pulses applied from a switch controller shown in FIG. 11 to a sampling switch array also shown in FIG. 11.
Figure 12B:
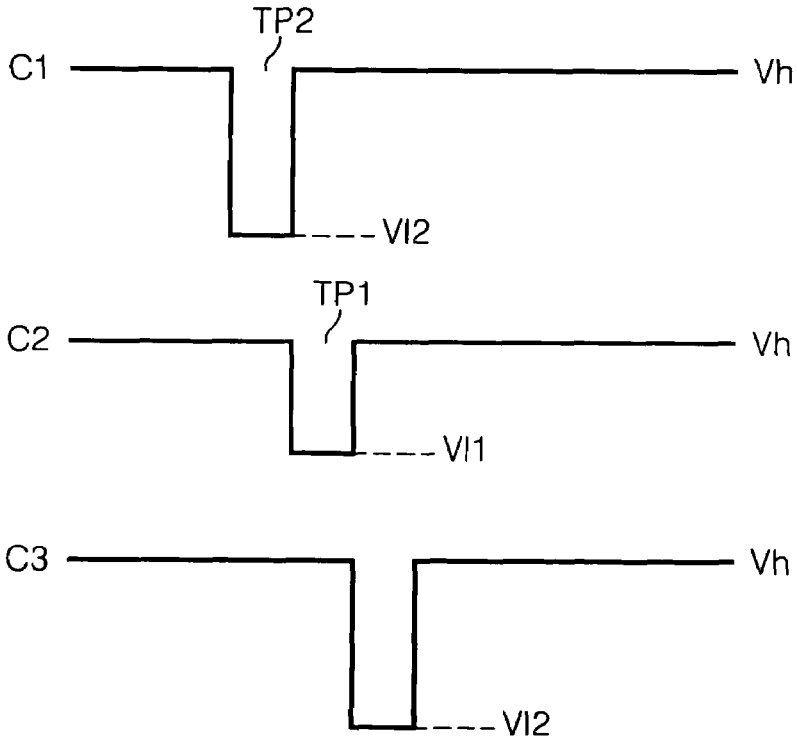

For example, and referring to FIGS. 12A and 12B, when the switching devices S1 to Sm are provided as PMOS transistors, the switch controller 64 may alternately apply first and second turn-on pulses TP1 and TP2, respectively, to the control lines C1 to Cm based on the polarity of video signals applied from the data supply lines PD. In one aspect of the present invention, an absolute voltage value of the first turn-on pulse TP1 (|Vh|−|Vl1|) may be less than an absolute voltage value of the second turn-on pulse TP2 (|Vh|−|Vl2|). Accordingly, the first turn-on pulse TP1 may define a low absolute voltage value while the second turn-on pulse TP2 may define a high absolute voltage value. In another aspect of the present invention, the switch controller 64 may apply the first turn-on pulse TP1 when a positive polarity video signal is applied from the data supply lines PD. In still another aspect of the present invention, the switch controller 64 may apply the second turn-on pulse TP2 when a negative polarity video signal is applied from the data supply lines PD.

Figure 13:
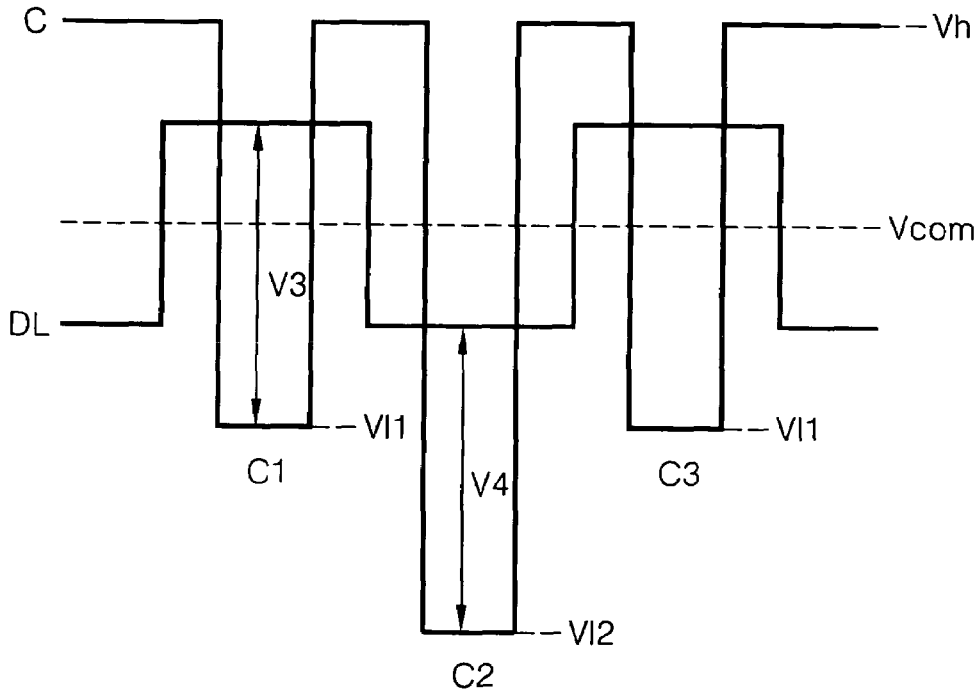
FIG. 13 illustrates a voltage difference generated between turn-on signals and video signals applied to PMOS switches within the sampling switch array shown in FIG. 11 according to principles of the present invention.

According to principles of the present invention, when the first and second turn-on pulses TP1 and TP2 are alternately applied to the control lines C1 to Cm, the resistance difference between switching devices S1 to Sm can be substantially minimized, as shown with respect to FIG. 13.

For example, and while referring to FIG. 13, when the first turn-on pulse TP1, having the low absolute voltage value, is applied to the gate terminals of the PMOS switching devices S1 via the first control line C1, the PMOS switching devices S1 are turned on and a positive voltage is applied to corresponding data lines DL1, DLm+1, etc., connected to the turned-on PMOS switching devices S1. Accordingly, the Vgs value of the switching devices S1 has a voltage value of V3. When a second turn-on pulse TP2, having the high absolute voltage value, is applied to the gate terminals of the PMOS switching devices S2 via the control line C2, the PMOS switching devices S2 are turned on and a negative voltage is applied to corresponding data lines DL2, DLm+2, etc., connected to the turned-on PMOS switching devices S2. Accordingly, the Vgs value of the switching devices S2 has a voltage value of V4, substantially equal to the voltage value V3.

Accordingly, the absolute voltage value of the turn-on pulses TP applied to the control lines C1 to Cm, as well as the V3 and V4 voltage values, correspond to the polarity of the video signals to be applied to the data lines DL. As a result, the turn-on resistance of the switching devices may be maintained to be substantially uniform in the presence of different polarity video signals, allowing pictures to be displayed within the picture display area 52 substantially uniformly.

Figure 1:
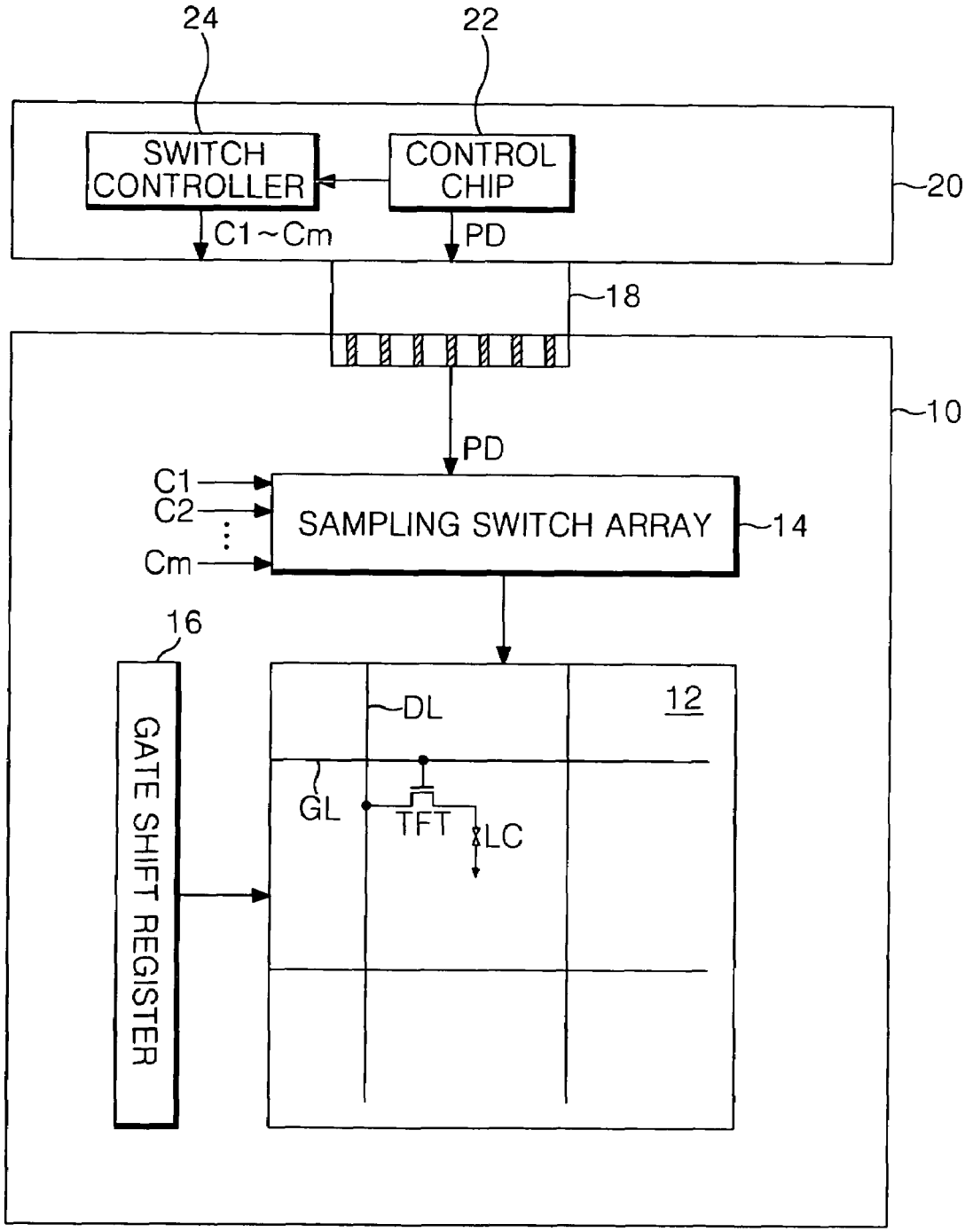
FIG. 1 RELATED ART
FIG. 1 schematically illustrates a related art liquid crystal display (LCD) device incorporating polycrystalline silicon-type thin film transistors (TFTs)
Figure 2:
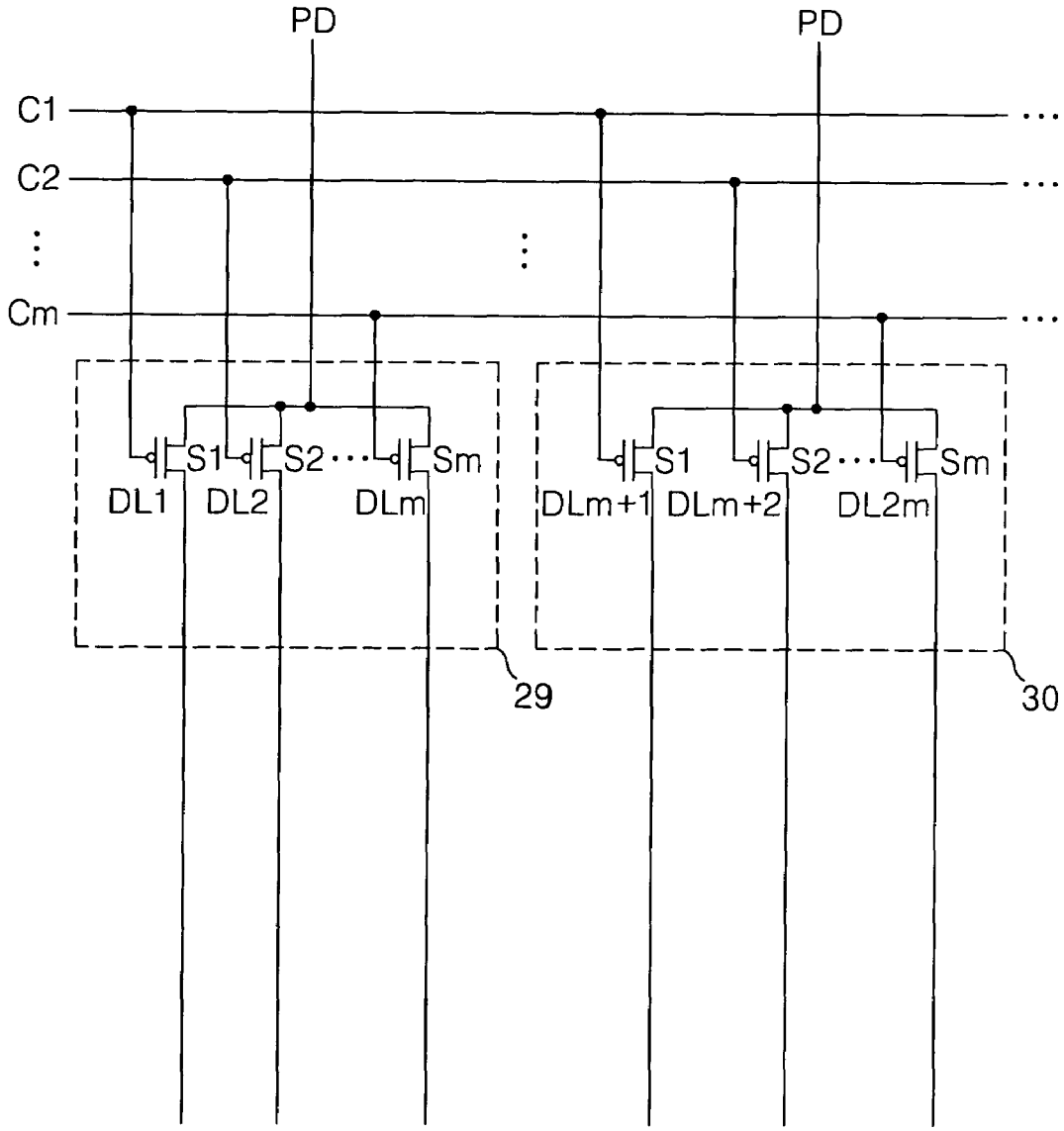
FIG. 2 RELATED ART
FIG. 2 illustrates the sampling switch array shown in FIG. 1.
Figure 3:
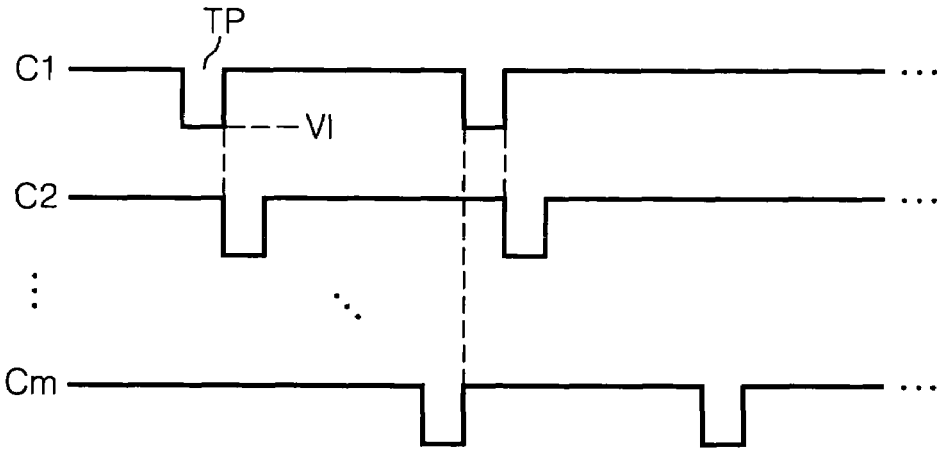
FIG. 3 RELATED ART
FIG. 3 illustrates turn-on pulses applied from a switch controller shown in FIG. 1 to the sampling switch array.
Figure 4:
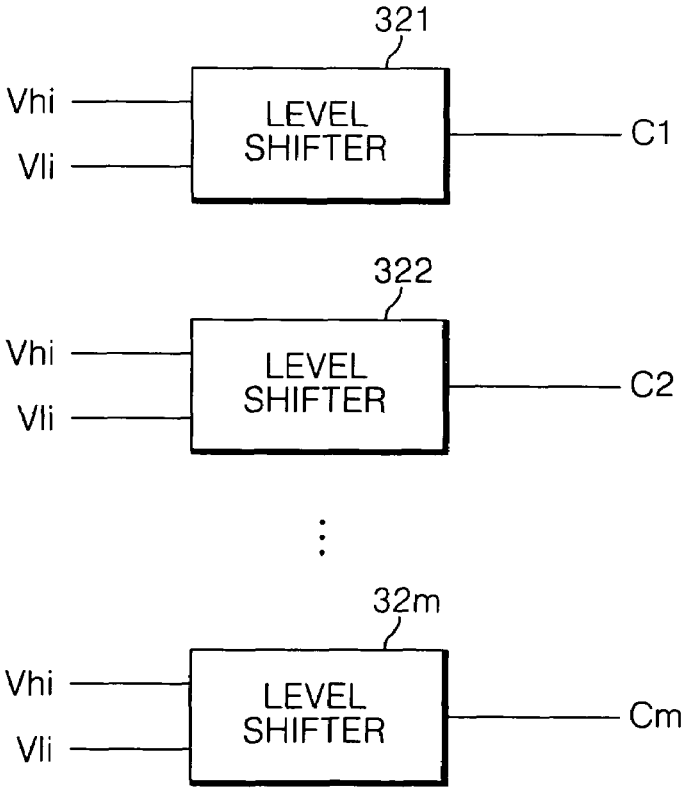
FIG. 4 RELATED ART
FIG. 4 illustrates the switch controller shown in FIG. 1.
Figure 5A:
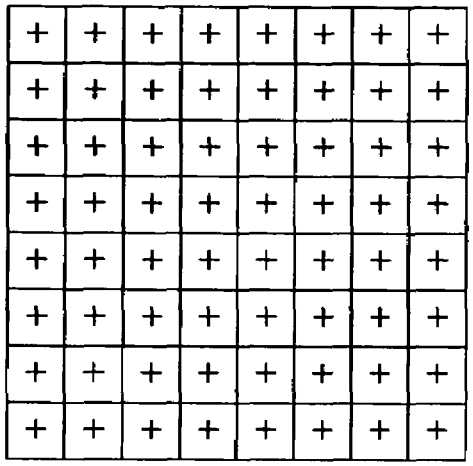
FIG.5A RELATED ART
FIGS. 5A and 5B illustrate polarity distribution within liquid crystal cells LC shown in FIG. 1, driven according to a frame inversion method.
Figure 5B:
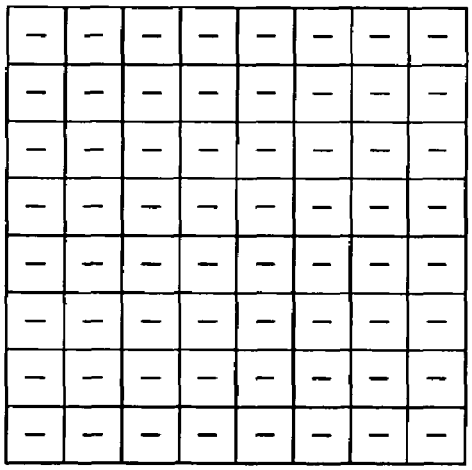
FIG.5B RELATED ART
Figure 9:
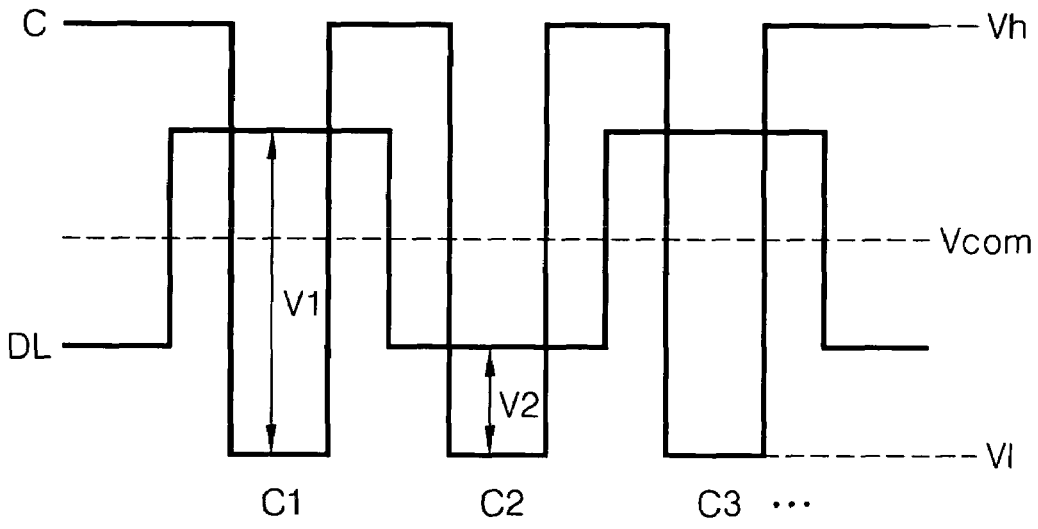
FIG.9 RELATED ART
FIG. 9 illustrates voltage differences generated between turn-on signals and video signals applied to PMOS switching devices within the sampling switch array shown in FIG. 1.

Moreover, the voltage value V4 is greater than the voltage value V2, discussed above with respect to FIG. 9. Accordingly, and while the turn-on resistance R of the PMOS switching device is inversely proportional to an absolute value of an applied voltage, the turn-on resistance R of the switching device S may be lowered compared to the corresponding related art switching device. As a result, the power consumption of the PMOS switching devices S of the present invention decreases as does the time required to charge liquid crystal cells LC connected to the data line DL.

According to principles of the present invention, the LCD device shown in FIG. 11 may be driven according to the line, column, or dot inversion methods, wherein the line inversion method has been described above. Where the LCD device is to be driven according to the dot inversion method, the turn-on pulses shown in FIGS. 12A and 12B may be alternately applied to each of the control lines whenever a horizontal line changes and whenever a frame changes. Where the LCD device is to be driven according to the column inversion method, the turn-on pulses shown in FIG. 12A and 12B may be alternately to each of the control lines whenever a frame changes.

Figure 14:
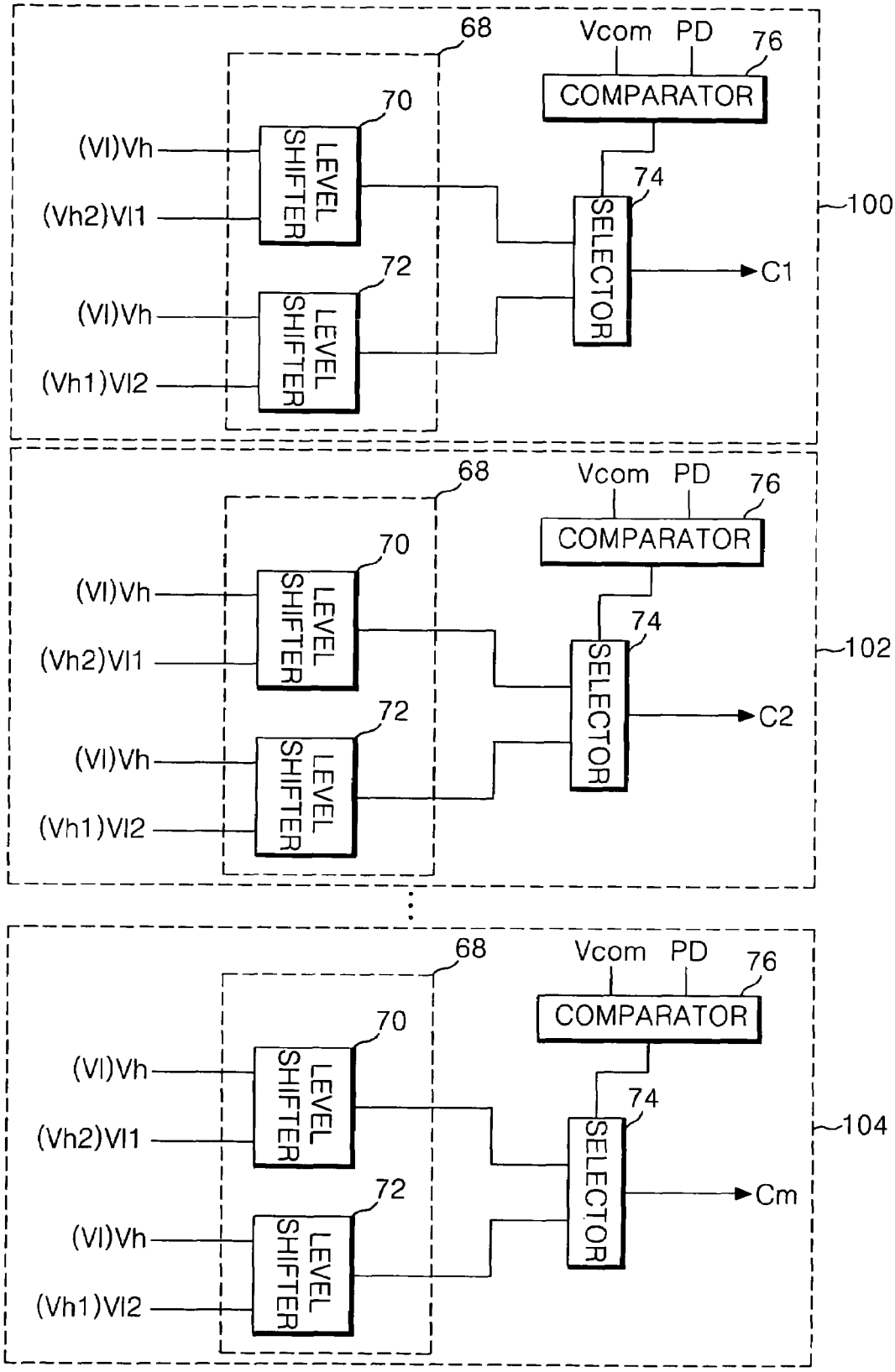
FIG. 14 illustrates a block diagram of a switch controller according to a first embodiment of the present invention.

FIG. 14 illustrates a block diagram of a switch controller according to a first embodiment of the present invention.

Referring to FIG. 14, the switch controller 64 according to a first embodiment of the present invention may, for example, include m number of pulse suppliers (e.g., 100, 102, 104, etc.) for applying the aforementioned turn-on pulses TP to corresponding ones of the m number of control lines C1 to Cm.

According to principles of the present invention, each of the pulse suppliers 100, 102, 104, etc., may, for example, include a comparator 76 for comparing a voltage value of a common voltage Vcom with a voltage value of a video signal applied from a corresponding data supply line PD, a first level shifter 70 for generating the first turn-on pulse TP1, a second level shifter 72 for generating the second turn-on pulse TP2, and a selector 74 for outputting one of the first and second turn-on pulses TP1 and TP2, respectively, based on a selection signal output by the comparator 76.

According to principles of the present invention, each comparator 76 may be connected to a predetermined one of the plurality of data supply lines PD and compare the voltage value of the common voltage Vcom with the voltage value of each video signal applied from the data supply line PD to generate the selection signal. In one aspect of the present invention, the comparator 76 may generate and output a first selection signal to the selector 74 when the voltage value of the common voltage Vcom is less than the voltage value of the video signal applied to the data supply line PD (e.g., when a positive video signal is applied to the data supply line PD). In another aspect of the present invention, the comparator 76 may generate and output a second selection signal to the selector 74 when the voltage value of the common voltage Vcom is greater than the voltage value of the video signal applied to the data supply line PD (e.g., when a negative video signal is applied to the data supply line PD).

According to principles of the present invention, m may be an even integer greater than one. Accordingly, each of the data supply lines PD may transmit a sequence of video signals such that the polarity sequence in which each of the video signals is transmitted by the data supply lines PD is the same. For example, if m is 4, four control lines C1 to C4 are provided and each of the data supply lines PD simultaneously transmit four sequential video signals, wherein the first of the transmitted video signals has a positive (+) polarity, the second of the transmitted video signals has a negative (−) polarity, the third of the transmitted video signals has a positive (+) polarity, and the fourth of the transmitted video signals has a negative (−) polarity.

Referring still to FIG. 14, the first level shifter 70 may receive a high voltage Vh (e.g., about 10V) and a first low voltage Vl1 (e.g., about −8V) from a power source (not shown). In receipt of the high and first low voltages Vh and Vl1, respectively, the first level shifter 70 may generate and apply a first turn-on pulse TP1 having a voltage between about 10V and about −8V to the selector 74.

The second level shifter 72 may receive the high voltage Vh (e.g., about 10V) and a second low voltage Vl2 (e.g., about −13V) from a power source (not shown). In receipt of the high and second low voltages Vh and Vl2, respectively, the second level shifter 72 may generate and apply a second turn-on pulse TP2 having a voltage between about 10V and about −13V to the selector 74.

Next, the selector 74 may output either the first turn-on pulse TP1 or the second turn-on pulse TP2 to a corresponding one of the m number of control lines C based on the selection signal output by the comparator 76. For example, the selector 74 may apply the first turn-on pulse TP1 to the corresponding control line C when the first selection signal is output by the comparator 76. However, the selector 74 may apply the second turn-on pulse TP2 to the corresponding control line C when the second selection signal is output from the comparator 76. Accordingly, the first and second turn-on pulses TP1 and TP2 may be selectively applied to the control lines C1 to Cm, as shown in FIG. 13, in accordance with the polarity of the video signals applied by the data supply lines DP.

According to principles of the present invention, the switch controller 64 described above with respect to FIG. 14 may arranged either on the LCD panel 50 or on the PCB 60. In one aspect of the present invention, only the selectors 74 may be arranged on the LCD panel 50.

Figure 15:
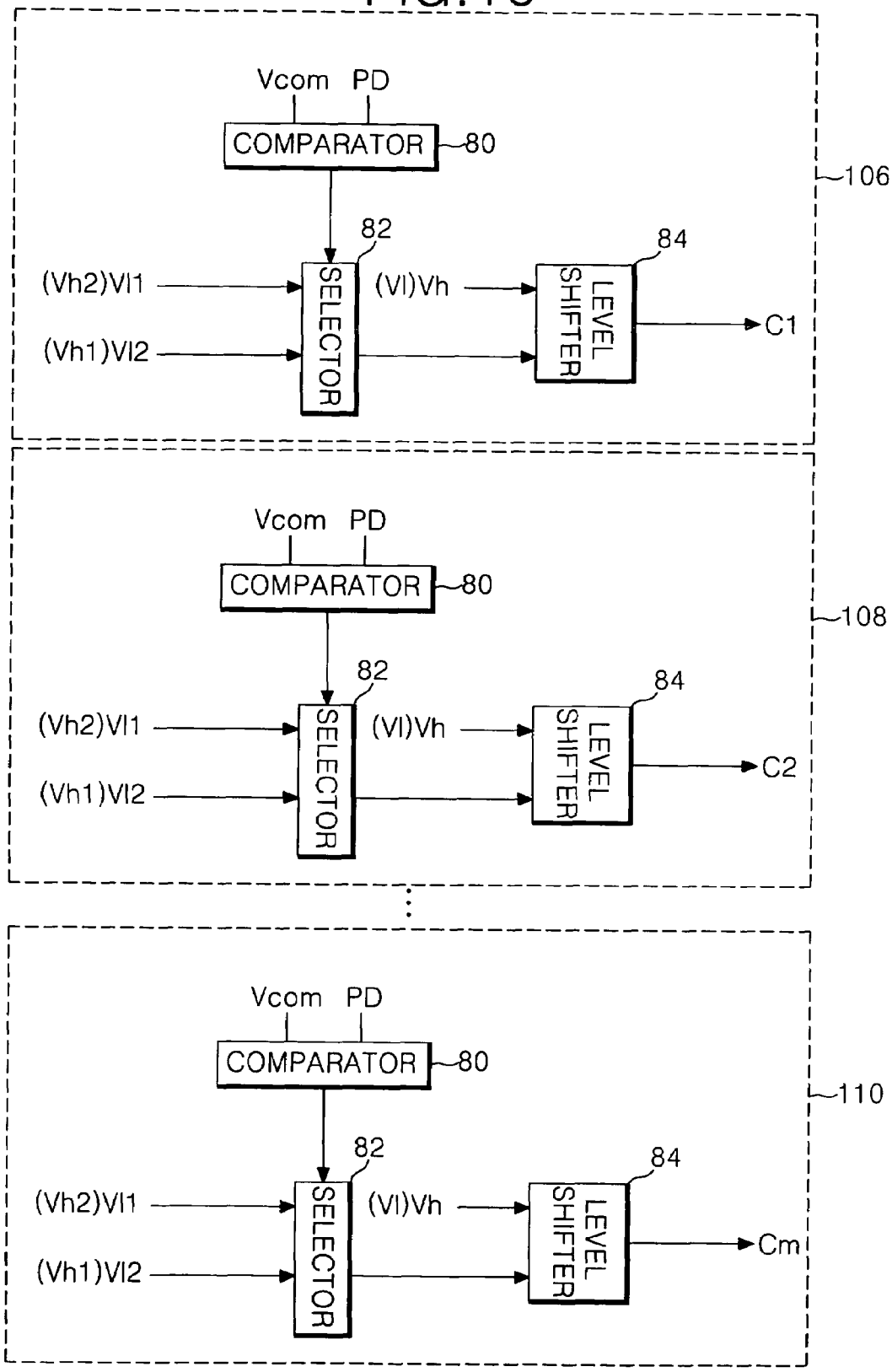
FIG. 15 illustrates a block diagram of a switch controller according a second embodiment of the present invention.

FIG. 15 illustrates a block diagram of a switch controller according to a second embodiment of the present invention.

Referring to FIG. 15, the switch controller 64 according to a second embodiment of the present invention may, for example, include m number of pulse supplies (e.g., 106, 108, 110, etc.) for applying the aforementioned turn-on pulses TP to corresponding ones of m number of control lines C1 to Cm.

According to principles of the present invention, each of the pulse suppliers 106, 108, 110, etc., may, for example, include a comparator 80 for comparing a voltage value of a common voltage Vcom with a voltage value of a video signal applied from a corresponding data supply line PD, a selector 82 for outputting one of first and second low voltages Vl1 and Vl2, respectively, based on a selection signal output by the comparator 80, and a level shifter 84 for generating a first or second turn-on pulse TP1 or TP2, respectively, based on a high voltage Vh applied from a power source (not shown) and a voltage output by the selector 82.

According to principles of the present invention, each comparator 80 may be connected to a predetermined one of the plurality of data supply lines PD and compare the voltage value of the common voltage Vcom with the voltage value of the video signal applied from the supply line PD to generate a selection signal. In one aspect of the present invention, the comparator 80 may generate and output a first selection signal to the selector 82 when the voltage value of the common voltage Vcom is less than the voltage value of the video signal applied to the data supply line PD (e.g., when a positive video signal is applied to the data supply line PD). In another aspect of the present invention, the comparator 80 may generate and output a second selection signal to the selector 82 when the voltage value of the common voltage Vcom is greater than the voltage value of the video signal applied to the data supply line PD (e.g., when a negative video signal is applied to the data supply line PD).

Next, the selector 82 may receive the first low voltage Vl1 and the second low voltage Vl2 from the power source and apply one of the first and second low voltages Vl1 and Vl2 to the level shifter 84 based on the selection signal output by the comparator 80. For example, the selector 82 may apply the first low voltage Vl1 to the level shifter 84 when the first selection signal is output by the comparator 80. However, the selector 82 may apply the second low voltage Vl2 to the level shifter 84 when the second selection signal is output by the comparator 80.

Referring still to FIG. 15, the level shifter 84 may generate a first turn-on pulse TP1 having a voltage between about 10V and about −8V and apply the generated first turn-on pulse TP1 to the control line C when the first low voltage Vl1 is output by the selector 82. However, the level shifter 84 may generate a second turn-on pulse TP2 having a voltage between about 10V and about −13V and may apply the generated pulse to the control line C when the second low voltage Vl2 is output by the selector 82. Accordingly, the first and second turn-on pulses TP1 and TP2 may be selectively applied to the control lines C1 to Cm, as shown in FIG. 13, in accordance with the polarity of the video signals applied by the data supply lines DP.

According to principles of the present invention, the switch controller 64 described above with respect to FIG. 15 may arranged either on the LCD panel 50 or on the PCB 60.

Described thus far, the switching devices S1 to Sm have been provided as PMOS transistors. However, the aforementioned switching devices S1 to Sm may be provided as NMOS transistors.

Figure 16A:
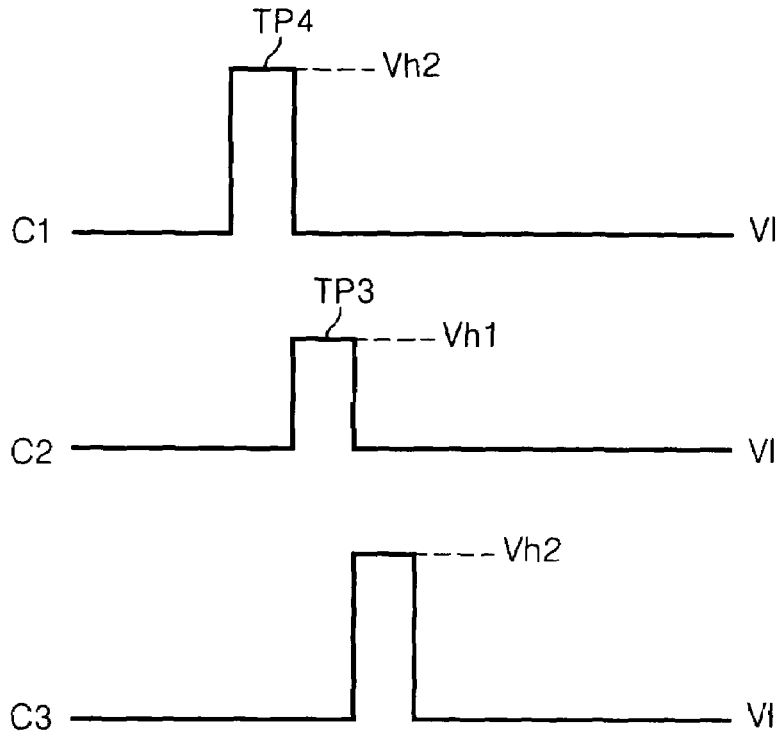
FIGS. 16A and 16B illustrate turn-on pulses applied from the switch controller shown in FIG. 15 to a sampling switch array shown in FIG. 11.
Figure 16B:
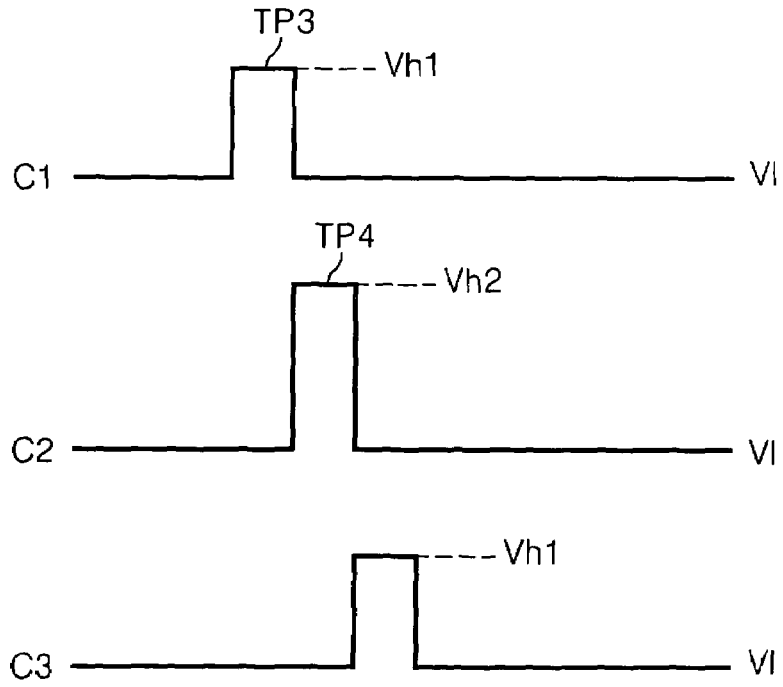

Referring now to FIGS. 16A and 16B, when the switching devices S1 to Sm are provided as NMOS transistors, the switch controller 64, described above with respect to FIG. 11, may alternately apply third and fourth turn-on pulses TP3 and TP4, respectively, to the control lines C1 to Cm based on the polarity of video signals applied from the data supply lines PD. In one aspect of the present invention, an absolute voltage value of the third turn-on pulse TP3 (|Vh1|−|Vl|) may be less than an absolute voltage value of the fourth turn-on pulse TP4 (|Vh2|−|Vl|). Accordingly, the third turn-on pulse TP3 may define a low absolute voltage value while the fourth turn-on pulse TP4 may define a high absolute voltage value. In another aspect of the present invention, the switch controller 64 may apply the third turn-on pulse TP3 when a negative polarity video signal is applied from the data supply lines PD. In still another aspect of the present invention, the switch controller 64 may apply the fourth turn-on pulse TP4 when a positive polarity video signal is applied from the data supply lines PD.

Figure 17:
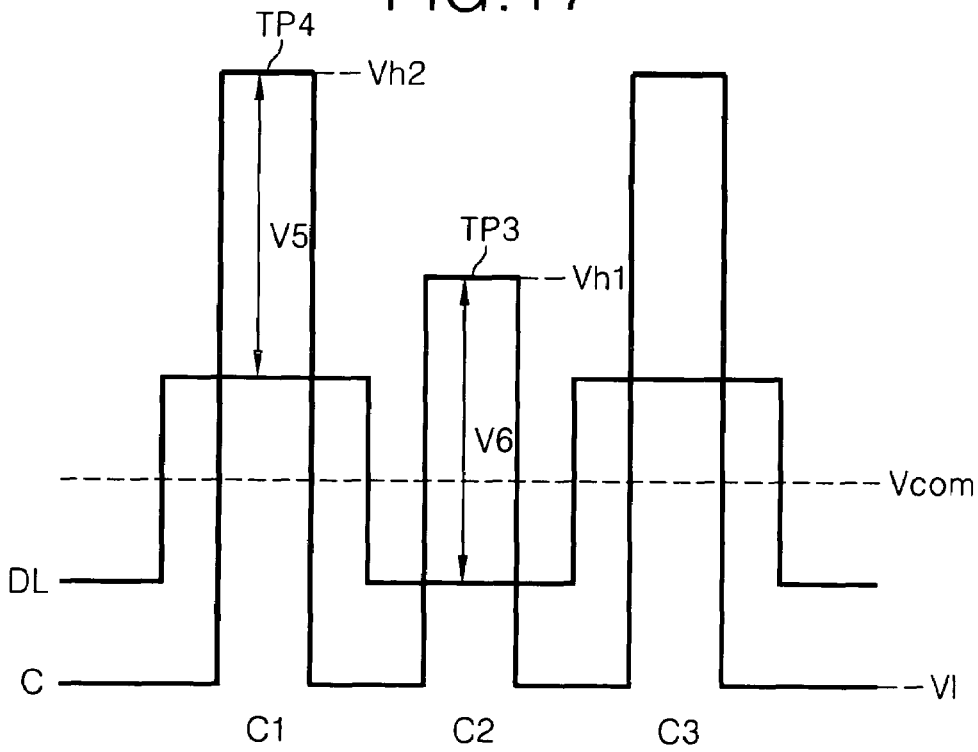
FIG. 17 illustrates a voltage difference generated between turn-on signals and video signals applied to NMOS switches within the sampling switch array shown in FIG. 11 according to principles of the present invention.

According to principles of the present invention, when the third and fourth turn-on pulses TP3 and TP4 are alternately applied to the control lines C1 to Cm, the resistance difference between switching devices S1 to Sm can be substantially minimized, as shown with respect to FIG. 17.

For example, and while referring to FIG. 17, when the fourth turn-on pulse TP4, having the high absolute voltage value, is applied to the gate terminals of the NMOS switching devices S1 via the first control line C1, the NMOS switching devices are turned on and a positive voltage is applied to corresponding data lines DL1, DLm+1, etc., connected to the turned-on NMOS switching devices S1. Accordingly, the Vgs value of the switching devices S1 has a voltage value of V5. When a second turn-on pulse T4, having the low absolute voltage value, is applied to the gate terminals of the NMOS switching devices S2 via the second control line C2, the NMOS switching devices S2 are turned on and a negative voltage is applied to corresponding data lines DL2, DLm+2, etc., connected to the turned-on NMOS switching devices S2. Accordingly, the Vgs value of the switching devices S2 has a voltage difference of V6, substantially equal to the voltage difference V5.

Accordingly, the absolute voltage value of the turn-on pulses TP applied to the control lines C1 to Cm, as well as the V5 and V6 voltage differences, correspond to the polarity of the video signals to be applied to the data lines DL. As a result, the turn-on resistance of the switching devices may be maintained to be substantially uniform in the presence of different polarity video signals, allowing pictures to be displayed within the picture display area 52 substantially uniformly.

Figure 10:
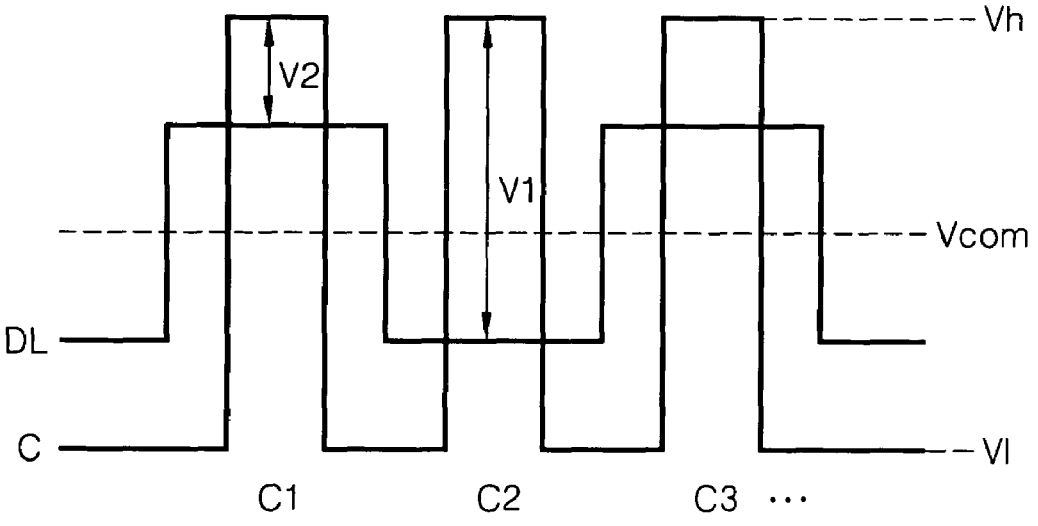
FIG.10 RELATED ART
FIG. 10 illustrates voltage differences generated between turn-on signals and video signals applied to NMOS switching devices within the sampling switch array shown in FIG. 1.

Moreover, the voltage difference V5 is greater than the voltage difference V2, discussed above, with respect to FIG. 10. Accordingly, and while the turn-on resistance R of the NMOS switching device is inversely proportional to an absolute value of an applied voltage, the turn-on resistance R of the switching device S may be lowered compared to the corresponding related art switching device. As a result, the power consumption of the NMOS switching devices S of the present invention decreases as does the time required to charge liquid crystal cells LC connected to the data line DL.

According to principles of the present invention, the LCD device shown in FIG. 11 may be driven according to the line, column, or dot inversion methods, wherein the line inversion method has been described above. Where the LCD device is to be driven according to the dot inversion method, the turn-on pulses shown in FIGS. 16A and 16B may be alternately applied to each of the control lines whenever a horizontal line changes and whenever a frame changes. Where the LCD device is to be driven according to the column inversion method, the turn-on pulses shown in FIGS. 16A and 16B may be alternately to each of the control lines whenever a frame changes.

According to principles of the present invention, when the aforementioned switching devices S are provided as NMOS transistors, voltages input to the switch controllers 64 described above with respect to FIGS. 14 and 15 may be changed such that the aforementioned third and fourth turn-on pulses TP3 and TP4 may be generated.

For example, and while referring to FIG. 14, where the switching devices S are provided as NMOS transistors, a low voltage V1 and a second high voltage Vh2 may be inputted to the first level shifter 70 while the low voltage V1 and a first high voltage Vh1, wherein, Vh2>Vh1, may be inputted to the second level shifter to enable the switch controller 64 to generate the third and fourth turn-on pulses TP3 and TP4.

Moreover, and while referring to FIG. 15, where the switching devices S are provided as NMOS transistors, the first high voltage Vh1 and the second high voltage Vh2 may be inputted to the selector 82 while the low voltage V1 may be inputted to the level shifter 84 to enable the switch controller 64 to generate the third and fourth turn-on pulses TP3 and TP4. In one aspect of the present invention, the selector 82 may output the second high voltage Vh2 when the first selection signal is output by the comparator 80. In another aspect of the present invention, the selector 82 may output the first high voltage Vh1 when the second selection signal is output by the comparator 80.

As described above, voltage values of turn-on pulses applied to a sampling switch array of an LCD device have magnitudes that depend on the polarity of video signals applied to data lines. Accordingly, the turn-on resistance of switching devices within the sampling switch array may remain substantially uniform. As a result, pictures can be displayed by the LCD device to a substantially uniform brightness, independent of the polarities of video signals applied to the data lines. Moreover, when negative (or positive) video signals are applied to the data lines, turn-on pulses having large absolute voltage values may be applied to lowering turn-on resistance values of the switching devices. By lowering the turn-on resistance values, the amount of time as well as the amount of energy required to charge liquid crystal cells may be reduced.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display (LCD) device, comprising:

an LCD panel having a plurality of data lines;

a control chip;

a sampling switch array coupled to the data lines and the control chip, wherein the control chip applies video signals to the data lines via the sampling switch array; and a switch controller coupled to the sampling switch array and the control chip, wherein the switch controller alternately applies a first turn on pulse having a first absolute value and a second turn-on pulse having a second absolute value to the sampling switch array in accordance with a polarity of the video signals applied from the control chip, and wherein the first absolute value is different from the second absolute value.

2. The liquid crystal display device according to claim 1, wherein the control chip includes a plurality of data supply lines that applies the video signals to the sampling switch array and the switch controller, wherein m number of video signals are sequentially supplied to each of the plurality of data supply lines, and wherein m is an even integer greater than 1.

3. The liquid crystal display device according to claim 2, wherein the sampling switch array includes a plurality of switching blocks connected to a corresponding one of the plurality of data supply lines, wherein each of the switching blocks includes m number of switching devices, and wherein the each of the switching devices divides the m number of video signals and applies the divided video signals to the plurality of data lines.

4. The liquid crystal display device according to claim 3, wherein the switch controller sequentially turns the switching devices on, wherein the video signals are applied to the switching devices that are turned on.

5. The liquid crystal display device according to claim 4, wherein the switching devices comprise PMOS transistors;

the switching controller applies the first turn-on pulse to the switching devices upon receipt of a video signal having a positive polarity; and the switching controller applies the second turn-on pulse to the switching devices upon receipt of a video signal having a negative polarity.

6. The liquid crystal display device according to claim 4, wherein the switching devices comprise NMOS transistors;

the switching controller applies the first turn-on pulse to the switching devices upon receipt of a video signal having a positive polarity; and the switching controller applies the second turn-on pulse to the switching devices upon receipt of a video signal having a negative polarity.

7. The liquid crystal display device according to claim 6, wherein the first turn-on pulse comprises a voltage rise from a first voltage value to a second voltage value, wherein the first voltage value has a negative polarity and the second voltage value has a positive polarity; and the second turn-on pulse comprises a voltage rise from the first voltage value to a third voltage value, wherein the third voltage value has a positive polarity, and wherein an absolute value of the third voltage value is less than an absolute voltage value of the second voltage value.

8. The liquid crystal display device according to claim 7, wherein the switch controller includes m number of pulse suppliers, wherein the pulse suppliers selectively apply first and second turn-on pulses to each of the m switching devices.

9. The liquid crystal display device according to claim 8, wherein each of the pulse suppliers include:

a first level shifter that generates the first turn-on pulse via the first and second voltage values;

a second level shifter that generates the second turn-on pulse via the first and third voltages values;

a comparator that compares a voltage value of a common voltage with a voltage value of the video signal; and a selector that applies one of the first and second turn-on pulses to the switching devices in accordance with a selection signal output by the comparator.

10. The liquid crystal display device according to claim 9, wherein the comparator applies a first selection signal to the selector when the voltage value of the video signal is greater than the voltage value of common voltage; and the comparator applies a second selection signal to the selector when the voltage value of the video signal is less than the voltage value of the common voltage.

11. The liquid crystal display device according to claim 10, wherein the selector applies the first turn-on pulse when the output selection signal comprises the first selection signal; and the selector applies the second turn-on pulse when the output selection signal comprises the second selection signal.

12. The liquid crystal display device according to claim 8, wherein each of the pulse suppliers includes:

a comparator that compares a voltage value of a common voltage with a voltage value of the video signal;

a selector that receives the second and third voltage values and for applying one of the second and third voltage values in accordance with a selection signal output by the comparator; and a level shifter that receives the first voltage value and for applying one of the first and second turn-on pulses to the switching devices and the voltage value applied by the selector.

13. The liquid crystal display device according to claim 12, wherein the comparator applies a first selection signal to the selector when the voltage value of the video signal is greater than the voltage value of the common voltage; and the comparator a second selection signal to the selector when the voltage value of the video signal is less than the voltage value of the common voltage.

14. The liquid crystal display device according to claim 13, wherein the selector applies the second voltage value when the output selection signal comprises the first selection signal; and the selector applies the third voltage value when the output selection signal comprises the second selection signal.

15. The liquid crystal display device according to claim 14, wherein the level shifter applies the first turn-on pulse when the voltage value applied by the selector comprises the second voltage value; and the level shifter applies the second turn-on pulse when the voltage value applied by the selector comprises the third voltage value.

16. The liquid crystal display device according to claim 1, wherein the switch controller is arranged within the LCD panel.

17. The liquid crystal display device according to claim 1, wherein the switch controller is arranged within a printed circuit board.

18. A liquid crystal display (LCD) device, comprising:

an LCD panel having a plurality of data lines;

a control chip;

a sampling switch array coupled to the data lines and the control chip, wherein the control chip applies video signals to the data lines via the sampling switch array; and a switch controller coupled to the sampling switch array and the control chip, wherein the switch controller alternately applies a first turn on pulse having a first absolute value and a second turn-on pulse having a second absolute value to the sampling switch array in accordance with a polarity of the video signals applied from the control chip, wherein the control chip includes a plurality of data supply lines that applies the video signals to the sampling switch array and the switch controller, wherein m number of video signals are sequentially supplied to each of the plurality of data supply lines, wherein m is an even integer greater than 1, wherein the sampling switch array includes a plurality of switching blocks connected to a corresponding one of the plurality of data supply lines, wherein each of the switching blocks includes m number of switching devices, and wherein the each of the switching devices divides the m number of video signals and applies the divided video signals to the plurality of data lines, wherein the switch controller sequentially turns the switching devices on, wherein the video signals are applied to the switching devices that are turned on, and the switching devices comprise PMOS transistors, wherein the switching controller applies the first turn-on pulse to the switching devices upon receipt of a video signal having a positive polarity; and the switching controller applies the second turn-on pulse to the switching devices upon receipt of a video signal having a negative polarity, and, wherein the first turn-on pulse comprises a voltage drop from a first voltage value to a second voltage value, wherein the first voltage value has a positive polarity and the second voltage value has a negative polarity; and the second turn-on pulse comprises a voltage drop from the first voltage value to a third voltage value, wherein the third voltage value has a negative polarity, and wherein an absolute value of the third voltage value is greater than an absolute voltage value of the second voltage value.

19. The liquid crystal display device according to claim 18, wherein the switch controller includes m number of pulse suppliers, wherein the pulse suppliers selectively apply first and second turn-on pulses to each of the m switching devices.

20. The liquid crystal display device according to claim 19, wherein each of the pulse suppliers includes:

a first level shifter that generates the first turn-on pulse via the first and second voltage values;

a second level shifter that generates the second turn-on pulse via the first and third voltage values;

a comparator that compares a voltage value of a common voltage with a voltage value of the video signal; and a selector that applies one of the first and second turn-on pulses to the switching devices in accordance with a selection signal output by the comparator.

21. The liquid crystal display device according to claim 20, wherein the comparator applies a first selection signal to the selector when the voltage value of the video signal is greater than the voltage value of the common voltage; and the comparator applies a second selection signal to the selector when the voltage value of the video signal is less than the voltage value of the common voltage.

22. The liquid crystal display device according to claim 21, wherein the selector applies the first turn-on pulse when the output selection signal comprises the first selection signal; and the selector applies the second turn-on pulse when the output selection signal comprises the second selection signal.

23. The liquid crystal display device according to claim 20, wherein the selector is arranged within the LCD panel; and the comparator, the first level shifter, and the second level shifter are arranged within a PCB.

24. The liquid crystal display device according to claim 19, wherein each of the pulse suppliers includes:

a comparator that compares a voltage value of a common voltage with a voltage value of the video signal;

a selector that receives the second and third voltage values and that applies one of the second and third voltage values in accordance with a selection signal output by the comparator; and a level shifter that receives the first voltage value and that applies one of the first and second turn-on pulses to the switching devices and the voltage value applied by the selector.

25. The liquid crystal display device according to claim 24, wherein the comparator applies a first selection signal to the selector when the voltage value of the video signal is greater than the voltage value of the common voltage; and the comparator applies a second selection signal to the selector when the voltage value of the video signal is less than the voltage value of the common voltage.

26. The liquid crystal display device according to claim 25, wherein the selector applies the second voltage value when the output selection signal comprises the first selection signal; and the selector applies the third voltage value when the output selection signal comprises the second selection signal.

27. The liquid crystal display device according to claim 26, wherein the level shifter applies the first turn-on pulse when the voltage value applied by the selector comprises the second voltage value; and the level shifter applies the second turn-on pulse when the voltage value applied by the selector comprises the third voltage value.

28. A method of driving a liquid crystal display (LCD) device including a plurality of switching blocks, each of which includes m number of switches and a switch controller supplying a control signal to each of the switches, wherein m represents an even integer greater than 1, the method comprising:

applying m number of video signals to a plurality of switching blocks; and alternately applying a first turn-on pulse or a second turn-on pulse to each of the switches to turn on the switches sequentially and applying the video signals to the data lines connected to the turned on switches, wherein each of the first turn on pulse and the second turn on-pulse includes a corresponding voltage change from a first voltage value that is one of a voltage drop or a voltage rise from the first voltage value, the magnitude of the voltage change for the first turn-on pulse having a different size than the voltage change for the second turn-on pulse.

29. The method according to claim 28, wherein the switches comprise PMOS transistors;

the first turn-on pulse comprises a voltage drop from a first voltage value to a second voltage value, wherein the first voltage value has a positive polarity and the second voltage value has a negative polarity; and the second turn-on pulse comprises a voltage drop from the first voltage value to a third voltage value, wherein the third voltage value has a negative polarity, and wherein an absolute value of the third voltage value is greater than an absolute value of the second voltage value.

30. The method according to claim 29, wherein the first turn-on pulse is applied to the switches upon receipt of a positive video signal by the switches; and the second turn-on pulse is applied to the switches upon receipt of a negative video signal by the switches.

31. The method according to claim 28, wherein the switches comprise NMOS transistors;

the first turn-on pulse comprises a voltage rise from a first voltage value to a second voltage value, wherein the first voltage value has a negative polarity and the second voltage value has a positive polarity; and the second turn-on pulse comprises a voltage rise from the first voltage value to a third voltage value, wherein the third voltage value has a positive polarity, and wherein an absolute value of the third voltage value is less than an absolute value of the second voltage value.

32. The method according to claim 31, wherein the first turn-on pulse is applied to the switches upon receipt of a negative video signal by the switches; and the second turn-on pulse is applied to the switches upon receipt of a positive video signal by the switches.

* * * * *